United States Patent [19]

Gordon

[11] Patent Number: 4,484,350

[45] Date of Patent: Nov. 20, 1984

[54] CONVERTIBLE PAPER BAG AND DOILY

[76] Inventor: Kenneth N. Gordon, 403 N. Columbia Ave., Columbus, Ohio 43209

[21] Appl. No.: 526,691

[22] Filed: Aug. 26, 1983

[51] Int. Cl.[3] ..... B65D 30/10

[52] U.S. Cl. ..... 383/4; 383/127; 493/243; 493/308; 493/916; 426/112

[58] Field of Search ..... 383/120, 4, 122, 105, 383/127; 493/243, 244, 308, 916; 426/112, 115

[56] References Cited

U.S. PATENT DOCUMENTS

| | | | |
|---|---|---|---|
| 529,656 | 11/1894 | Lorenz et al. | 493/244 |
| 2,344,369 | 3/1944 | Salfisberg | 383/105 X |
| 2,416,816 | 3/1947 | Campagnano | 383/38 |

FOREIGN PATENT DOCUMENTS

| | | | |
|---|---|---|---|
| 839405 | 9/1952 | Fed. Rep. of Germany | 383/38 |
| 292212 | 3/1936 | Italy | 383/40 |

*Primary Examiner*—Allan N. Shoap
*Assistant Examiner*—Bryon Gehman
*Attorney, Agent, or Firm*—William S. Rambo; Wm. Cates Rambo

[57] ABSTRACT

A glueless paper bag is formed from a single sheet of paper or similar flexible sheet material which is first folded longitudinally upon itself and then transversely to provide an open mouth bag having a closed bottom, pleated, relatively expansible sides, a single ply front wall, a multiple ply rear wall and a locking section which is tucked into the open mouth of the bag in overlying relation to the multiple ply rear wall thereof. The bag may be readily unfolded to provide a rectangular doily or napkin-forming sheet.

3 Claims, 5 Drawing Figures

CONVERTIBLE PAPER BAG AND DOILY

BACKGROUND OF THE INVENTION

This invention relates generally to paper bags and more particularly to a glueless paper bag which may be readily converted into a substantially flat, single sheet doily or napkin.

The increasing number of fast food, carry-out restaurants has stimulated so-called "brown bag" lunches and get togethers. However, one of the draw backs to "brown bagging" is the usual absence of a doily or cloth which may be spread out upon a lawn or table surface to provide a comparatively neat and cleanly food-support surface, or alternatively, act as a napkin or bib.

In the past, paper bags have been formed from a single sheet or blank of paper material which is folded and glued to form a generally rectangular, multiple ply bottom wall, pleated side walls, and relatively opposing, single ply front and back walls. Ordinarily, the plys making up the bottom wall and the relatively overlapping free edge portion of the blank were joined by glue or other adhesive, so as to maintain a bag configuration.

While the glued bags of the prior art could be torn apart or otherwise severed along the glued areas thereof to form a substantially flat sheet, this often proved a difficult task and the torn or severed product was generally unsightly. Further, in the case of relatively small size bags, the area of the torn or severed sheet was often times too small to provide an efficient doily or napkin.

SUMMARY AND OBJECTS OF THE INVENTION

This invention provides an adhesiveless bag which may be readily and easily converted into a substantially flat, rectangular single ply doily or napkin and vice versa. In accordance with this invention, a rectangular blank or sheet of paper, or comparable flexible sheet material, is folded longitudinally upon itself to initially form an elongated, open-ended, relatively flat tube made up of relatively opposite inner and outer panels joined by pleated side walls. The inner panel of the tube includes the longitudinal, free edge portions of the blank which are relatively interleaved, so as to close the tube along its length. The tube, in turn, is folded along two relatively spaced apart, transverse fold lines to form three relatively connecting sections, namelyan open mouth bag or pocket-forming section having a closed bottom, a multiple ply rear section and a multiple ply locking section which is folded and tucked into the open mouth of the bag-forming section in overlying relation to the rear section. Thus folded, the blank is securely held against accidental release in a bag-forming configuration. However, when it is desired to convert the bag into a substantially flat doily, or napkin, this may be readily accomplished simply by withdrawing the locking section from the open mouth of the bag and then unfolding the blank and smoothing it into a single thickness sheet.

The primary object of this invention is to provide a combination food-carry out bag and doily which may be furnished by fast food restaurants and the like to its customers, and which may be readily converted by simple unfolding from a bag into a substantially flat, single thickness doily, napkin, or bib.

For a further and more detailed understanding of the invention, reference is made to the following description and the accompanying drawings.

DESCRIPTION OF PREFERRED EMBODIMENT

Figure 1:
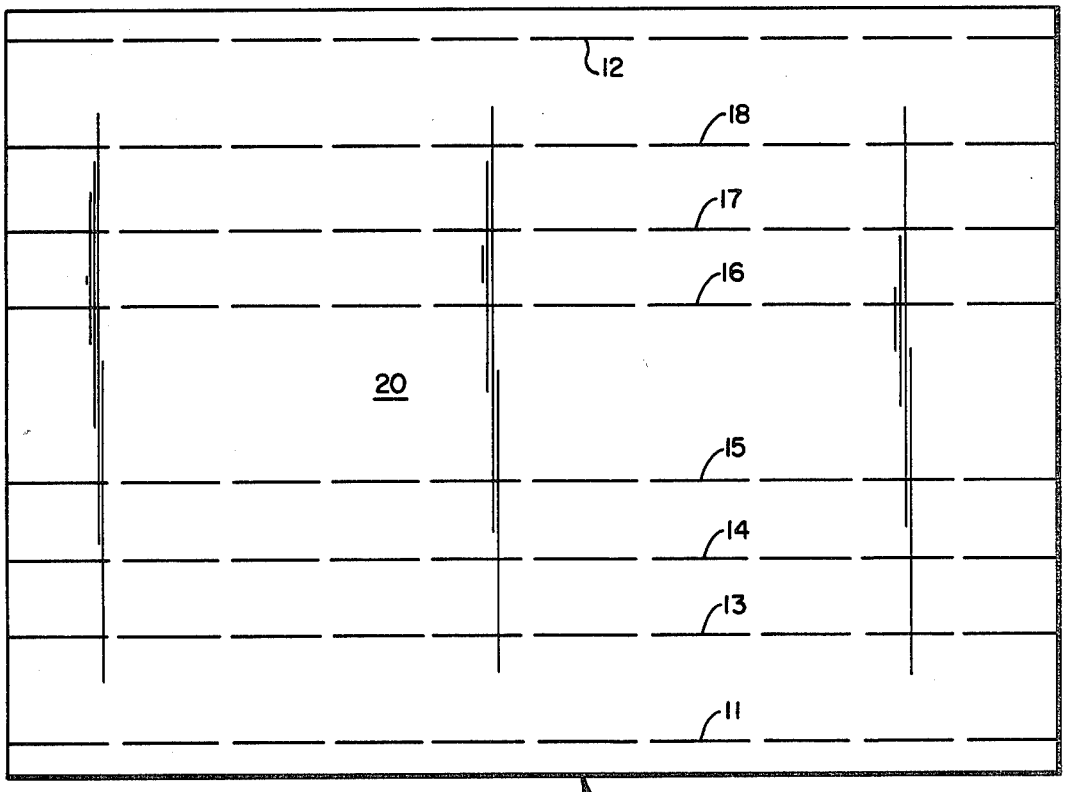
FIG. 1 is a plan view of a sheet or blank used to form a convertible bag according to the present invention.

Referring now to the drawing, FIG. 1 illustrates a generally rectangular blank or sheet 10 of flexible, readily foldable material such as paper, plastic film or cloth. The blank 10 is formed or otherwise provided with eight relatively spaced apart, parallel fold lines 11, 12, 13, 14, 15, 16, 17, and 18 which extend longitudinally the full length of the blank.

Figure 2:
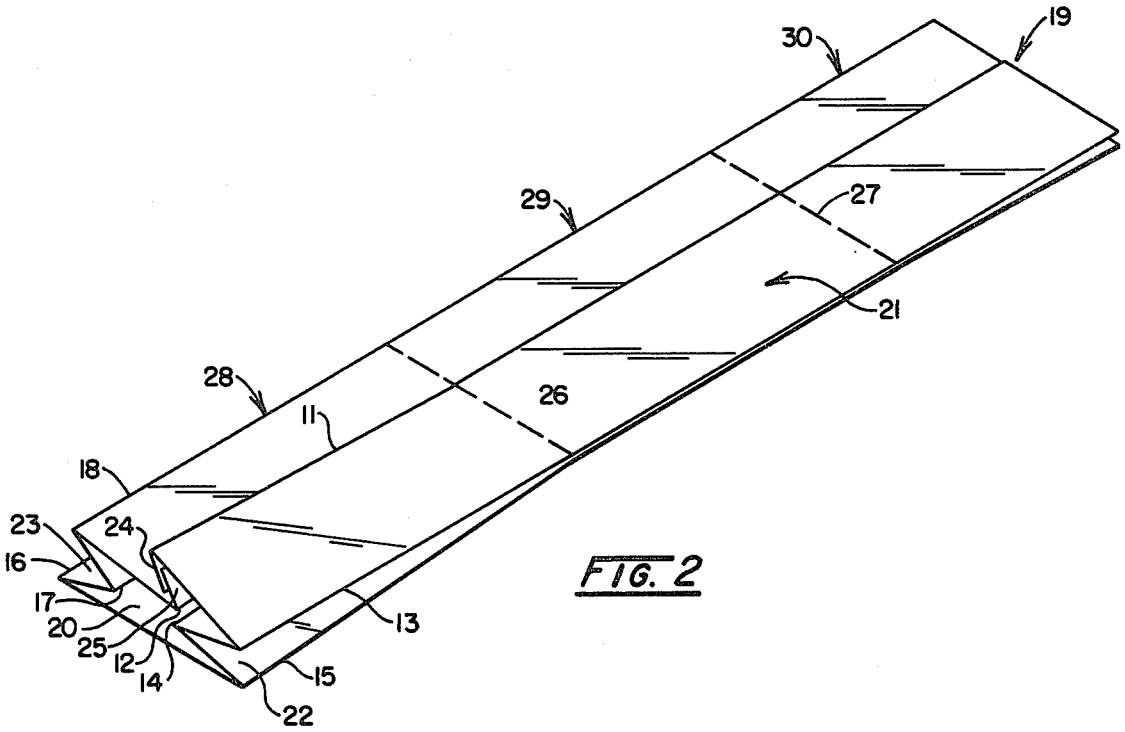
FIG. 2 is a perspective view of the blank folded longitudinally into an intermediate tubular configuration.

The blank 10 is folded along the longitudinal fold lines, as indicated in FIG. 2, to initially form an elongated, rectangular, substantially flat, open-ended tube 19. The tube 19 comprises an outer panel 20, an inner panel 21 and a pair of accordian-pleated side walls 22 and 23. The inner panel 21 includes in its central, longitudinal region the interleaved, or relatively overlapped, and interlocking free edge portions 24 and 25 which are defined by the fold lines 11 and 12 of the blank 10.

Figure 3:
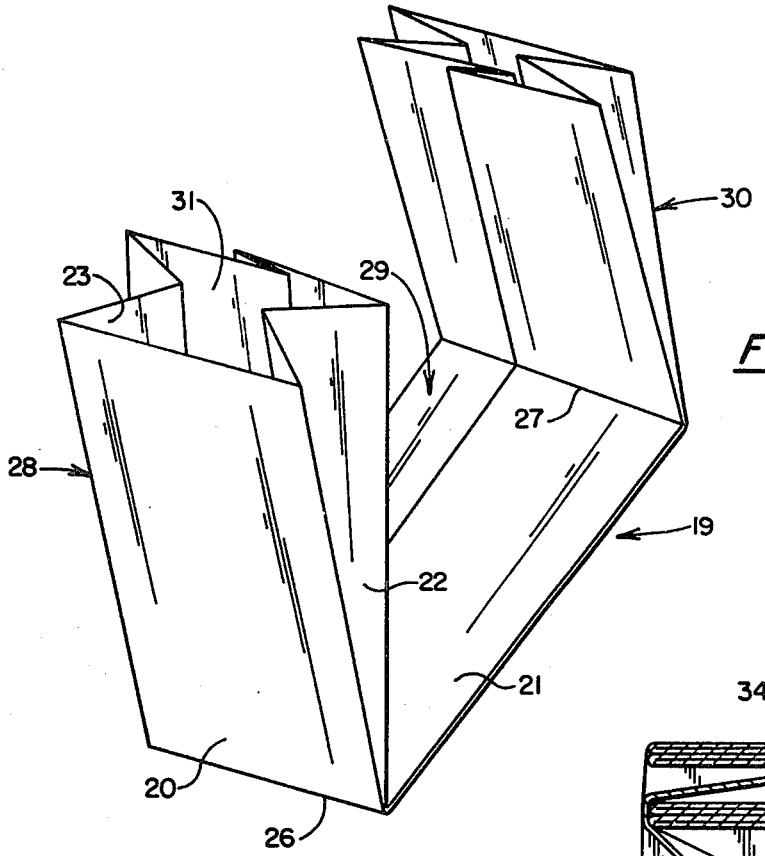
FIG. 3 is a similar view, but showing the intermediate tubular piece being folded transversely.
Figure 5:
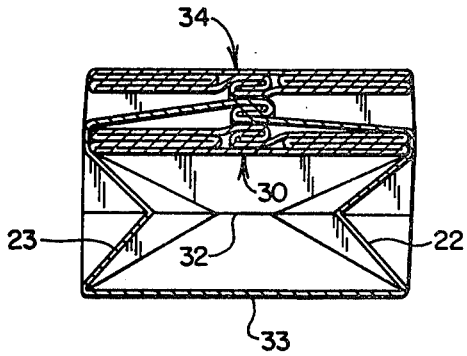
FIG. 5 is a transverse cross sectional view taken approximately along the line 5—5 of FIG. 4.

The tube 19 is then folded transversely along a pair of relatively spaced, transverse fold lines 26 and 27 (see FIG. 3) to form three, generally rectangular and relatively adjoining sections, namely: a forward, open-mouth bag section 28, a multiple ply backing section 29, and a multiple ply tucking and locking section 30. The sections 28, 29 and 30 are substantially equal in length and are assembled into a bag configuration by folding the backing section 29 upwardly against the rear or inner wall of the bag section 28 and then tucking the locking section 30 downwardly into the open mouth 31 of the bag section 28 and into overlying relation to the backing section 29. In this condition (see FIG. 4), the smooth and uninterrupted outer panel 20 of the blank is outermost, and the relatively interlocking, interleaved free edge portions 24 and 25 of the blank are fully covered and held against accidental separation.

When thus folded and tucked, the blank forms an open mouth bag or receptacle having a closed bottom 32, pleated sides 22 and 23, a front wall or panel 33, a multiple ply rear wall 34 and a multiple ply locking section 30 disposed within the bag in adjacent, overlying relation to the rear or inner wall of the bag section 28.

Figure 4:
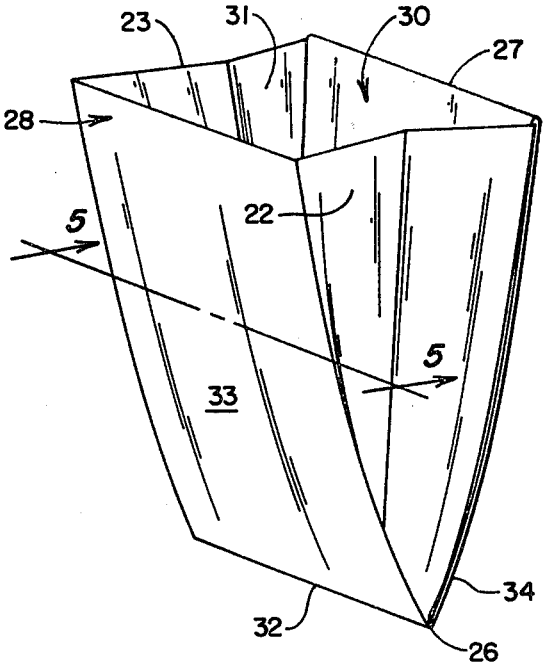
FIG. 4 is a perspective view of the finally folded bag.

In operation, the present device is convertible from the flat, rectangular sheet or blank shown in FIG. 1 to the open mouth bag shown in FIG. 4, and vice versa, simply by folding or unfolding as the case may be. For example, the device may be used in the configuration shown in FIG. 4 as a carry-out bag for a sandwich or other food, and upon arrival at a convenient eating spot, it may be easily unfolded to its flat blank configuration, as shown in FIG. 1, and used as a doily, napkin or bib.

In view of the foregoing, it will be seen that this invention provides a useful and highly versatile, glueless bag or receptacle which may be readily converted, simply by unfolding, into a flat, single thickness doily, napkin, or bib.

While a single preferred embodiment of this invention has been illustrated and described in detail, it will be understood that various changes in design and details of construction may be made without departing from the spirit of the invention or the scope of the following claims.

I claim:

1. A convertible, glueless bag comprising a generally rectangular blank of flexible sheet material folded longitudinally upon itself to define an elongated, rectangular open-ended tube made up of an outer panel, an inner panel and pleated side walls joining said inner and outer panels, one of the panels of said tube including relatively interleaved free edge portions of said blank; said tube being folded transversely upon itself to form a generally rectangular, open mouth bag having a closed bottom, pleated sides, front wall, a multiple ply rear wall and a multiple ply locking section tucked within the open mouth of the bag and overlying at least the rear wall of said bag; said bag being unfoldable without tearing to provide a substantially flat, generally rectangular doily-forming sheet.

2. A convertible, glueless bag according to claim 1, wherein the inner panel of said tube includes the interleaved free edge portions of said blank, and wherein said tube is folded transversely upon itself to cover the interleaved free edge portions of said blank.

3. A convertible, glueless bag according to claim 1, wherein said blank consists of a single sheet of paper.

* * * * *